US008136195B2

(12) United States Patent
Michelson

(10) Patent No.: US 8,136,195 B2
(45) Date of Patent: Mar. 20, 2012

(54) HANDLE FOR A FLOOR CLEANING IMPLEMENT

(75) Inventor: Robert Michelson, Wayland, MA (US)

(73) Assignee: Butler Home Products, LLC, Marlborough, MA (US)

( * ) Notice: Subject to any disclaimer, the term of this patent is extended or adjusted under 35 U.S.C. 154(b) by 0 days.

(21) Appl. No.: 12/433,389

(22) Filed: Apr. 30, 2009

(65) Prior Publication Data

US 2009/0211045 A1 Aug. 27, 2009

Related U.S. Application Data

(63) Continuation of application No. 11/027,751, filed on Dec. 30, 2004, now Pat. No. 7,581,274.

(51) Int. Cl.
*A46B 5/02* (2006.01)
*B25G 1/10* (2006.01)

(52) U.S. Cl. ..... 15/143.1; 16/436

(58) Field of Classification Search ..... 15/143.1; 16/436; 294/57

See application file for complete search history.

(56) References Cited

U.S. PATENT DOCUMENTS

| | | | | | |
|---|---|---|---|---|---|
| 1,421,098 | A | * | 6/1922 | Phillips | 74/551.9 |
| 1,609,414 | A | | 12/1926 | Lenny | |
| 2,123,813 | A | | 7/1938 | Stiles | |
| 2,619,368 | A | * | 11/1952 | Anderson | 403/164 |
| 3,232,355 | A | | 2/1966 | Woolworth | |
| 4,232,422 | A | * | 11/1980 | Fellmann | 16/427 |
| 5,581,839 | A | | 12/1996 | Ferrell, Jr. | |
| 5,690,181 | A | * | 11/1997 | Shu | 172/378 |
| 5,887,314 | A | | 3/1999 | Jordan, Jr. | |
| 5,920,944 | A | | 7/1999 | Biggs et al. | |
| D417,934 | S | | 12/1999 | Footer | |
| 6,003,187 | A | | 12/1999 | Footer et al. | |
| 6,101,661 | A | | 8/2000 | Policchio et al. | |
| D458,721 | S | | 6/2002 | Clarke | |
| 6,434,793 | B1 | | 8/2002 | Ensson | |
| D482,873 | S | | 12/2003 | Greenberg | |
| D486,616 | S | | 2/2004 | Hall et al. | |
| 7,117,955 | B2 | | 10/2006 | Rivers et al. | |
| D547,017 | S | | 7/2007 | Van Landingham, Jr. | |
| 2002/0026680 | A1 | | 3/2002 | Kingry et al. | |
| 2003/0200631 | A1 | | 10/2003 | Clarke | |

* cited by examiner

*Primary Examiner* — Randall Chin
(74) *Attorney, Agent, or Firm* — McCarter & English LLP

(57) ABSTRACT

A handle for an implement for cleaning a surface, such as a floor, includes an elongated pole, an end cap and a hang cap. The elongated pole has a top end and a bottom end. The bottom end of the elongated pole is adapted to be coupled to a cleaning head on the implement. The end cap is fixedly mounted over the top end of the pole and the hang cap is movably mounted over the end cap. The end cap and hang cap are constructed so that when the hang cap is mounted in place on the end cap, the hang cap may rotate relative to the end cap but cannot move up or down relative to the end cap. The hang cap may define a hole for removably mounting the implement on a hook attached to a wall.

16 Claims, 4 Drawing Sheets

HANDLE FOR A FLOOR CLEANING IMPLEMENT

CROSS-REFERENCE TO RELATED APPLICATIONS

This application is a continuation of U.S. patent application Ser. No. 11/027,751, filed Dec. 30, 2004, now U.S. Pat. No. 7,581,274, the contents of which are expressly incorporated by reference in their entirety as part of the present disclosure.

BACKGROUND OF THE INVENTION

The present invention relates generally to floor cleaning implements and more particularly to handles for floor cleaning implements.

Floor cleaning implements are well known and widely used to clean hard flooring surfaces such as ceramic tile, hardwood, laminate, linoleum and marble floors. Examples of floor cleaning implements are mops, dusters and brooms. Floor cleaning implements usually include a cleaning head and a cleaning element. The cleaning element is either fixedly mounted on the cleaning head or removably mounted on the cleaning head. Examples of cleaning elements are sponges, brushes and sheets of fabric material.

Floor cleaning implements also usually include a handle. The handle usually comprises an elongated pole about 3½ to 4½ feet in length and having a top end and a bottom end. The bottom end of the pole is attached, either fixedly or pivotally, to the cleaning head. The handle also often includes a hang cap which is attached to the top end of the pole. The purpose of the hang cap is to enable a person to hang the cleaning implement on a hook, which may be on a wall or other surface, rather then have the cleaning implement rest on a floor. Hang caps are shaped either straight (i.e. their longitudinal axis is straight) or angled (i.e. their longitudinal axis is bent at an angle in the vicinity of around 130 to 150 degrees). Some straight hang caps are fixedly mounted onto the top end of the pole while other straight hang caps are rotatably mounted onto the top end of the pole so that the pole can necessarily rotate, relative to the hang cap to position the cleaning head at the bottom of the pole at the proper orientation with the wall on which the hook is attached.

In U.S. Published Patent Application No. 2002/0026680 to G. W. Kingry et al. there is disclosed a cleaning implement, such as a floor mop. The cleaning implement includes a handle and a cleaning head attached to the handle. The handle includes a hang cap. The cleaning head has at least one attachment structure for receiving and retaining a sheet about the cleaning head. The attachment structure includes a base triangle and a plurality of substantially pie-shaped sections whose apexes meet at a substantially common point adjacent the base triangle. Two sides of the base triangle and two sides of each of the pie shaped sections are defined by slits passing through the flexible material forming the attachment structure such that the base triangle and each of the pie-shaped sections can be defected to receive the sheet. In U.S. Pat. No. 6,101,661 to N. J. Policchio et al. there is disclosed a cleaning implement comprising a handle and a removable cleaning pad. The cleaning pad is designed to provide multiple cleaning surfaces each of which contact the soiled surface during the cleaning operation. The cleaning pad also preferably has the ability to absorb at least about 10 g of water per g of pad.

Other patents of interest are U.S. Pat. No. 5,887,314 to L. J. Jordon, Jr. which discloses a telescoping handle with multiple attachment heads, U.S. Pat. No. 6,003,187 to H. Footer et al. which discloses a mop having a hang cap and U.S. Design Pat. 417,934 to H. Footer which discloses a mop having a hang cap.

It is, therefore, an object of this invention to provide a floor cleaning implement which includes a new and improved handle.

SUMMARY OF THE INVENTION

A handle for a floor cleaning implement constructed according to this invention comprises an elongated pole, a hang cap and an end cap, the elongated pole having a top end and a bottom end, the bottom end of the pole being adapted to be coupled to a cleaning head on the floor cleaning implement, the end cap being fixedly mounted to the top end of the pole and the hang cap being mounted to the end cap. The hang cap can be either straight or angled. In one embodiment of the invention, the end cap and the hang cap are constructed so that when the hang cap is mounted in place on the end cap, the hang cap can move rotationally relative to the end cap but not up or down relative to the end cap. Since the hang cap can rotate on the end cap and the end cap is fixed relative to the pole, the pole can be rotated relative to the hang cap, if necessary, to orient the cleaning head properly when the cleaning implement is mounted on a hook attached to a wall or other surface.

The handle may be assembled as follows. First, the end cap is press fit down over the top end of the pole to fixedly mount the end cap on the pole. Then the hang cap is pushed down over the end cap until it snap fits in place.

Various other features and advantages will appear from the description to follow. In the description, reference is made to the accompanying drawings which form a part thereof, and in which is shown by way of illustration, various embodiments for practicing the invention. The embodiments will be described in sufficient detail to enable those skilled in the art to practice the invention, and it is to be understood that other embodiments may be utilized and that structural changes may be made without departing form the scope of the invention. The following detailed description is therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate particular embodiments of the invention and, together with the description, serve to explain the principles of the invention. In the drawings wherein like reference numerals represent like parts.

DETAILED DESCRIPTION OF THE INVENTION

Figure 1:
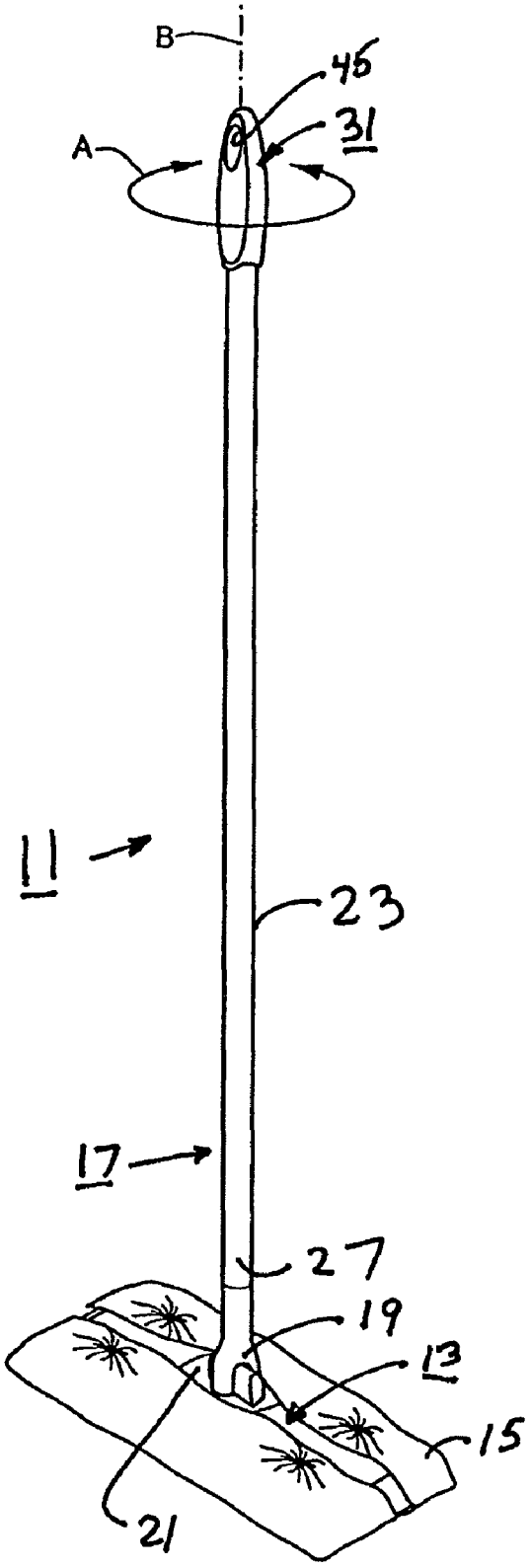
FIG. 1 is a perspective view of a cleaning implement having a handle according to this invention, the cleaning implement including a cleaning element attached to a cleaning head.
Figure 2:
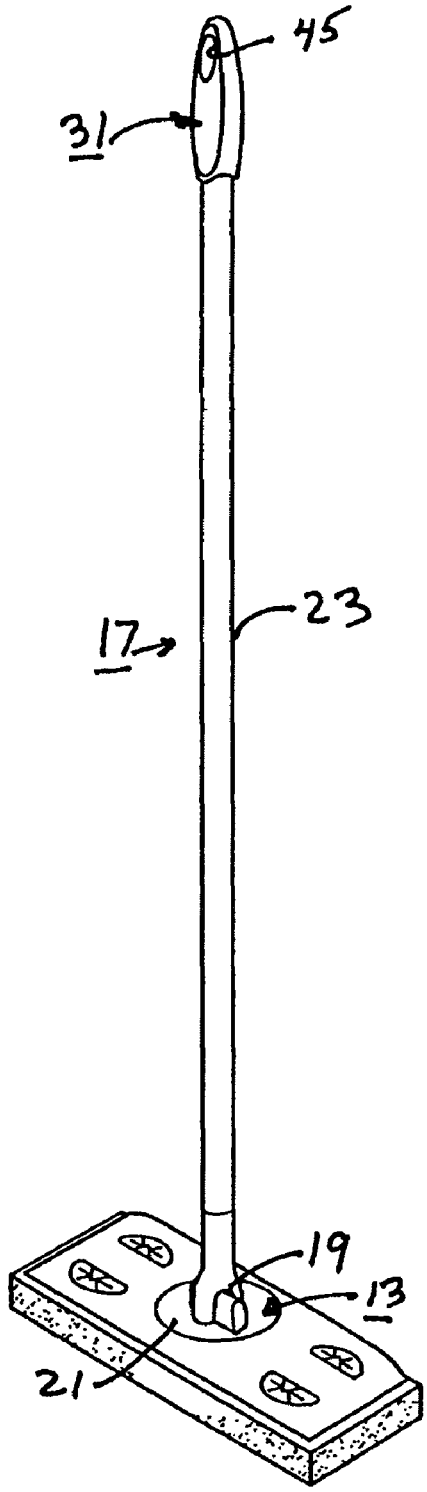
FIG. 2 is a perspective view of the cleaning implement shown in FIG. 1, but with the cleaning element removed.

Referring now to the drawings, and first to FIG. 1, there is shown a floor cleaning implement which includes a handle constructed according to this invention, the floor cleaning implement being identified by reference numeral 11.

Floor cleaning implement 11 includes a cleaning head 13, a cleaning element 15, such as a sheet of fabric material, removably mounted on cleaning head 13 and a handle 17 pivotally mounted on cleaning head 13. Cleaning head 13 includes a handle coupling member 19 which is pivotally mounted on a base 21.

Figure 3:
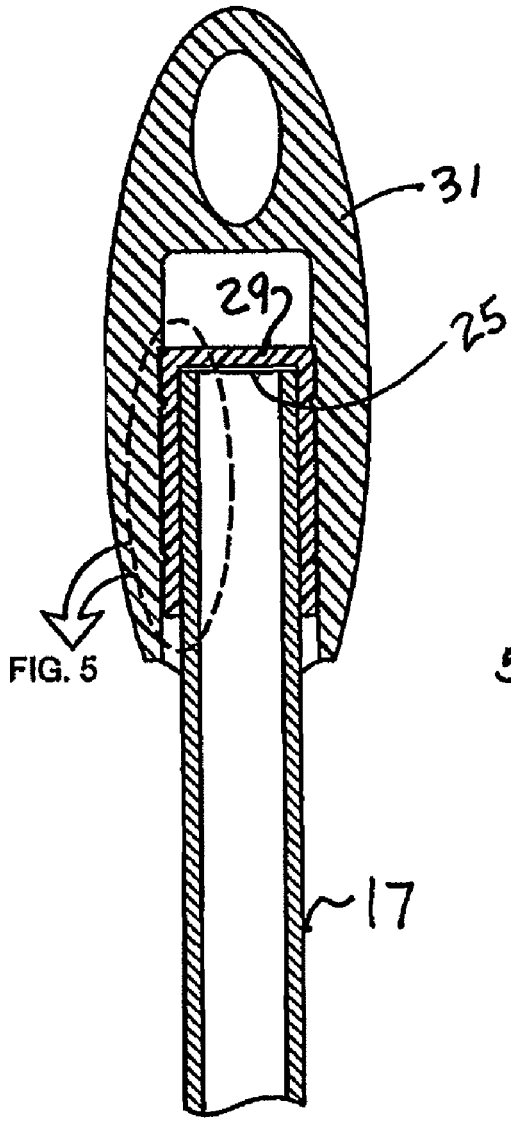
FIG. 3 is an enlarged fragmentary section view of the handle in the cleaning implement shown in FIG. 1.
Figure 5:
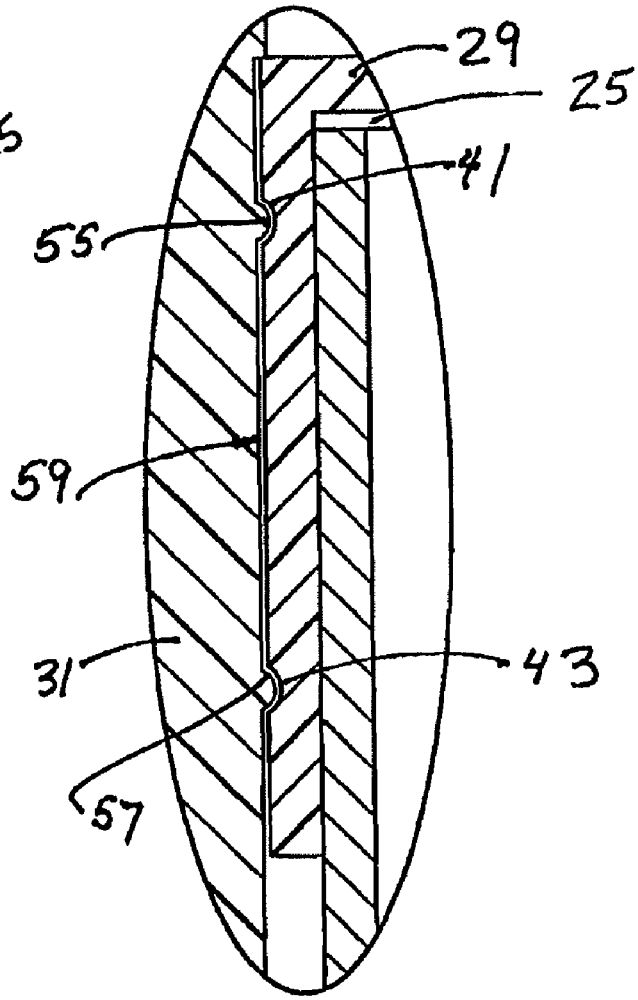
FIG. 5 is an enlarged view of a portion of the section view shown in FIG. 3.
Figure 4:
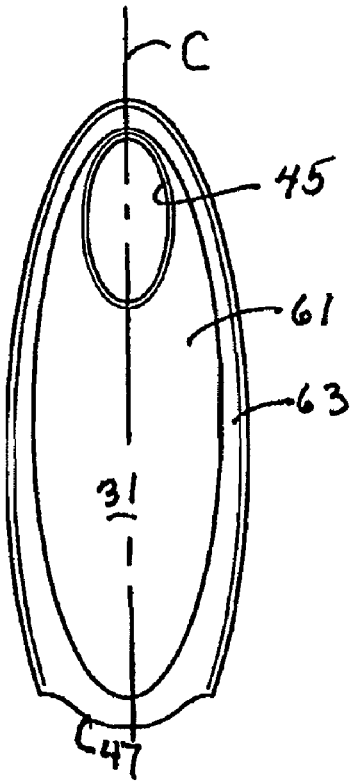
FIG. 4 is an enlarged front view of the hang cap shown in FIG. 1.
Figure 6:
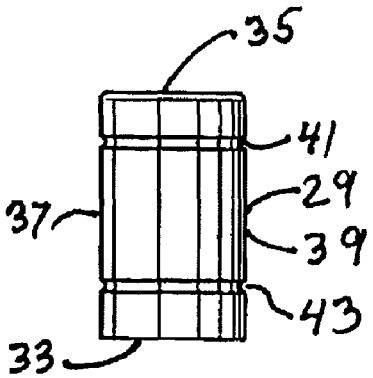
FIG. 6 is a front view of the end cap shown in FIG. 3.
Figure 7:
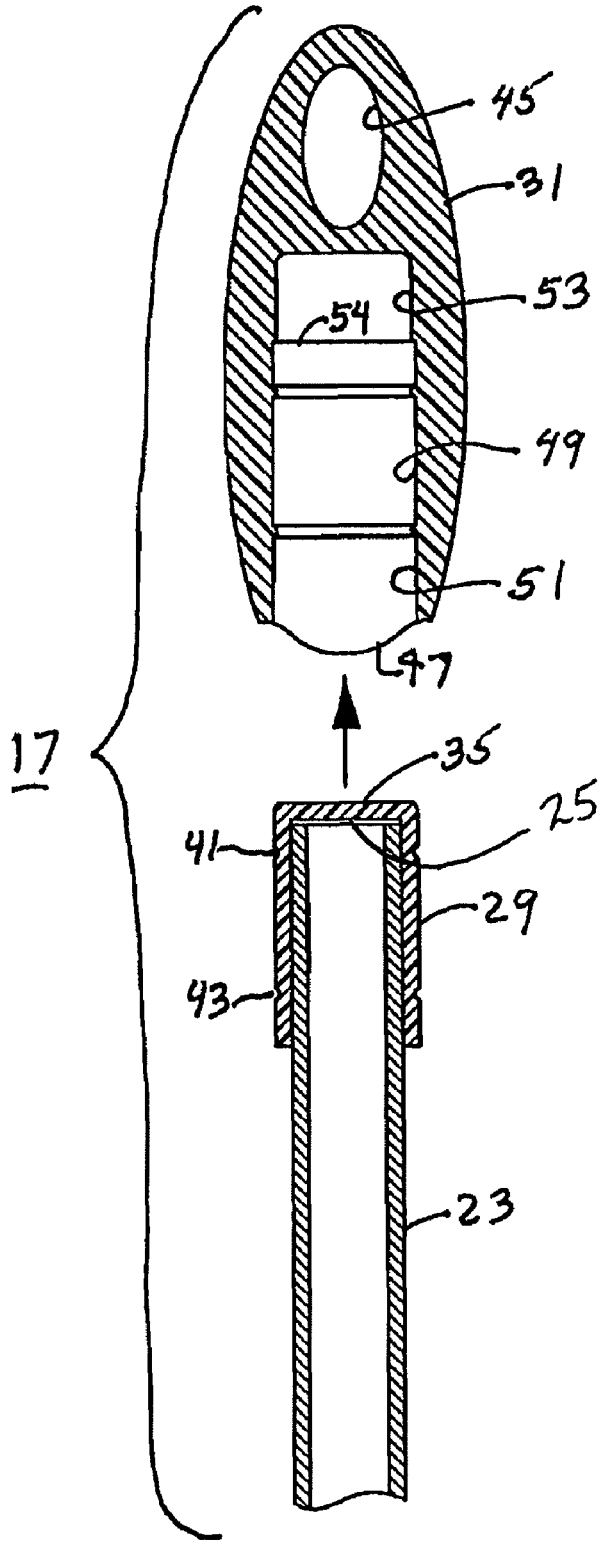
FIG. 7 is an exploded fragmentary view of the top of the handle shown in FIG. 3.

Handle 17, which is shown in detail in FIGS. 3 and 7 includes an elongated tubular pole 23 having a top end 25 and a bottom end 27. Bottom end 27 of pole 23 is fixedly secured by any suitable means such as glue or fasteners, not shown, to handle coupling member 19.

Handle 17 also includes an end cap 29 which is fixedly mounted over top end 25 of pole 23 and a hang cap 31 which is movably mounted over end cap 29. More specifically, end cap 29 and pole 23 are sized relative to each other so that end cap 29 can be press fit over top end 25 of pole 23. In addition, end cap 29 and hang cap 31 are sized and shaped relative to each other as will hereinafter be explained and shown so that hang cap 31 can be snap-fit over end cap 29 in a manner such that hang cap can 31 can rotate as shown in FIG. 1 in direction A about longitudinal axis B relative to end cap 29 but cannot move up or down relative to end cap 29.

As can be seen in the drawings, and in particular FIGS. 2, 3, 6 and 7, end cap 29 is an elongated tubular member having an open bottom 33, a closed top 35 and a sidewall 37 having an outer surface 39 that is generally cylindrically shaped. The inside cross sectional diameter of end cap 29 is very slightly larger than the outside cross-sectional diameter of pole 23 so that end cap 29 can be press-fit onto pole 23. A pair of spaced apart lateral grooves 41 and 43 are formed on outer surface 39 of end cap 29.

Hang cap 31 is a generally oval shaped member whose longitudinal axis C is straight. Hang cap 31 includes a hole 45 for use in hanging hang cap 31 on a hook or other similar means, an open bottom 47 and an axial bore 49 extending inward from open bottom 47 and which is generally circular in cross-section. Axial bore 49 includes an outer portion 51 and an inner portion 53. Outer portion 51 of bore 49 has a cross-sectional diameter slightly greater than the outside cross-sectional diameter of end cap 29. Inner portion 53 of bore 49 has a cross-sectional diameter less than the outside cross-sectional diameter of end cap 29.

As can be seen, movement by end cap 29 in an upward direction in outer portion 51 is limited in that end cap 29 can be pushed up in bore 49 only to the top 54 of bore 51. Thus, top 54 of outer portion 51 serves as a stop to limit upward movement of end cap 29 in bore 49.

A pair of spaced apart lateral ribs 55 and 57 are provided on the surface 59 of outer portion 51 of bore 49. Ribs 55 and 57 are sized, positioned and spaced on surface 59 so as to be in registration with grooves 41 and 43, respectively, on end cap 29 when end cap 29 is pushed up into bore 49 to the top 54 of outer portion 51. As a result, because ribs 55 and 57 are in grooves 41 and 43, respectively, hang cap 31 can rotate laterally in the direction shown by arrow A in FIG. 1 relative to end cap 29 (and pole 23) but cannot move either up or down relative to end cap 29.

End cap 29 is a single piece and may be made of a rigid plastic such as polypropylene. Hang cap 31 is a single piece that has an over-molding added to it. The main portion 61 may be a rigid plastic such as polypropylene while the over-molding portion 63 may be a plastic material such as TPP. The over molding portion 63 is for gripping purposes as well as appearance.

Handle 17 may be assembled in the following manner. First, end cap 29 is press-fit onto top end 25 of pole 23. Then, hang cap 31 is pushed down over end cap 29 until it snap-fits in place (i.e. when ribs 55 and 57 align with grooves 41 and 43). Then, handle 17 is attached to cleaning head 13. Alternatively, handle 17 may be attached to cleaning head 13 before end cap 29 and hang cap 31 are mounted onto it.

Figure 8:
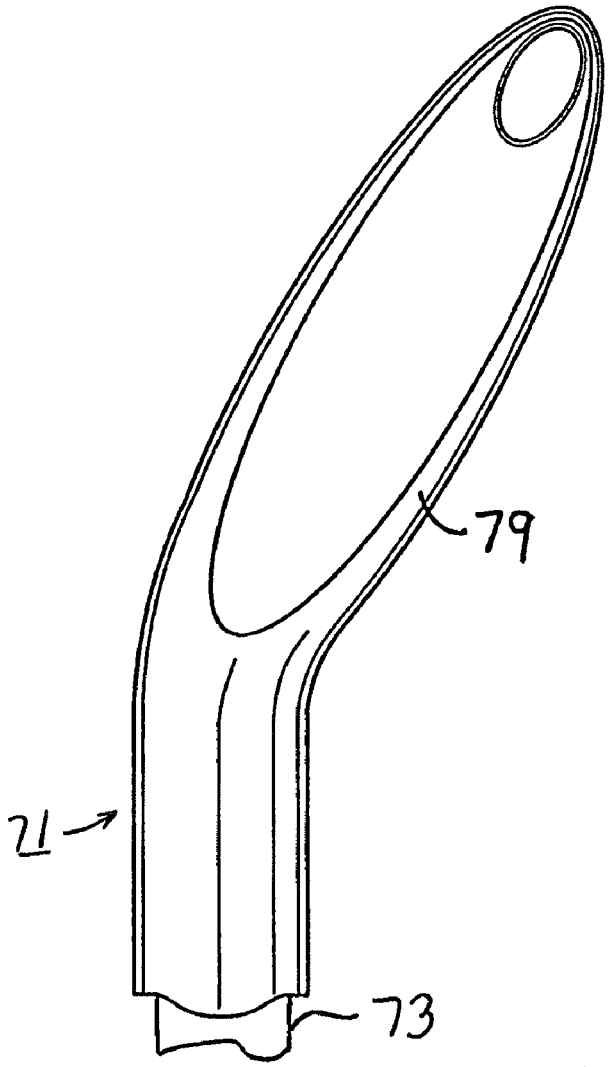
FIG. 8 is a fragmentary front view of a handle having another embodiment of a hang cap according to this invention.
Figure 9:
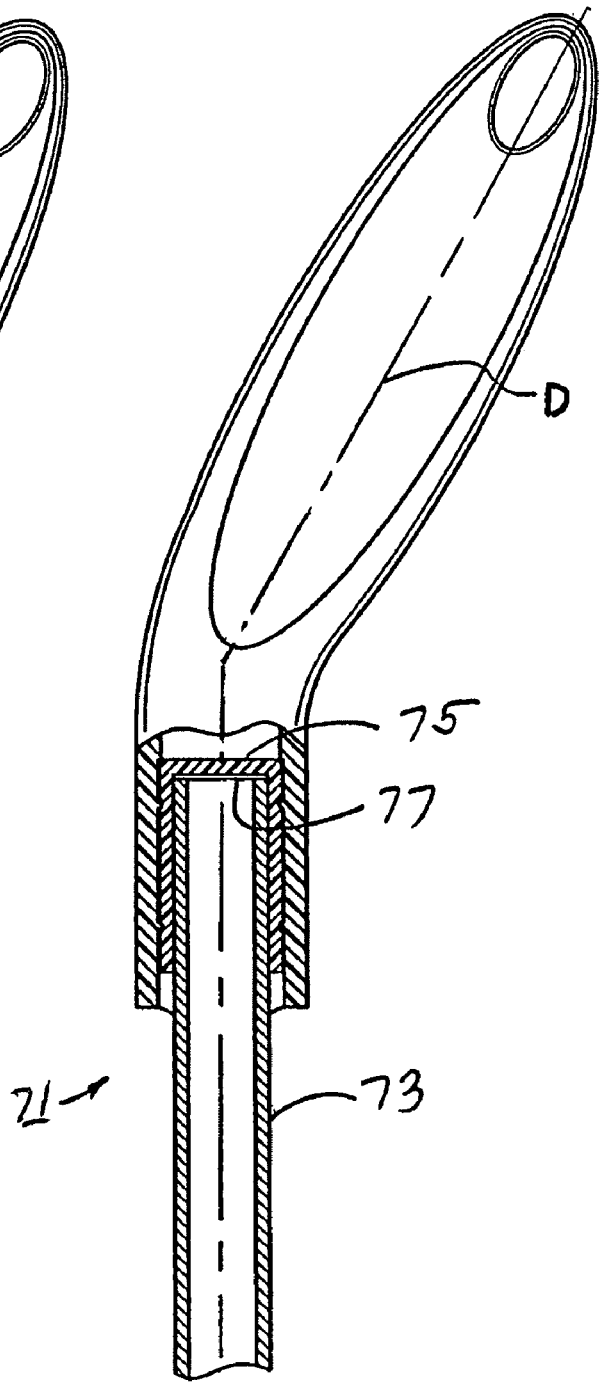
FIG. 9 is a fragmentary view partly in section of the handle shown in FIG. 8.

Referring now to FIGS. 8 and 9, there is shown another embodiment of a handle according to this invention, the handle being identified by reference numeral 71.

Handle 71 includes a pole 73, identical to pole 23, an end cap 75 fixedly mounted on top end 77 of pole 73 and which is identical to end cap 29, and a hang cap 79 which is movably mounted on end cap 75 such that it can rotate relative to end cap 75 but cannot move either up or down relative to end cap 75. Hang cap 79 has a longitudinal axis D that is angled (i.e. bent). Except for the fact that its longitudinal axis D is bent, hang cap 79 is identical to hang cap 31.

Handle 71 is assembled in the same manner as handle 17.

Although the invention has been described with regard to a handle for a floor cleaning implement it should be understood that the handle could be used, if desired, with other types of implements such as garden tools or carpet cleaning tools.

The embodiments shown in the present invention are intended to be merely exemplary and those skilled in the art shall be able to make numerous variations and modifications to them without departing from the spirit of the present invention. All such variations and modifications are intended to be within the scope of the present invention as defined in the appended claims.

What is claimed is:

1. A cleaning implement comprising:
- a cleaning head
- a cleaning element on the cleaning head, that is made of a different material than the cleaning head, and
- a handle, the handle comprising:
  - an elongated pole having a top end and a bottom end, the bottom end attached to the cleaning head, and
  - an angled hang cap consisting of a substantially straight connecting portion, defining a central longitudinal axis, and operatively attached to the top end of the pole, and a substantially straight axially elongated gripping portion extending directly from the connecting portion, at an angle relative to the central longitudinal axis, to an end of the cleaning implement, the gripping portion having a hole for use in removably mounting the cleaning implement onto a hook attached on a wall or other surface.

2. A cleaning implement as defined in claim 1, wherein at least one of the connecting portion and gripping portion is rotatable relative to the pole.

3. A cleaning implement as defined in claim 1, further comprising an end cap attached to the top end of the pole, wherein the connecting portion of the hang cap is attached to the end cap.

4. A cleaning implement as defined in claim 3, wherein the end cap is fixedly mounted over the top end of the pole, and the hang cap defines an axial bore for slidably receiving and engaging the end cap.

5. A cleaning implement as defined in claim 3, wherein the hang cap is rotatable relative to the end cap.

6. A cleaning implement as defined in claim 5, wherein the hang cap is prevented from moving axially along the central longitudinal axis.

7. A cleaning implement as defined in claim 6, wherein the end cap defines a first surface and the hang cap defines a second surface, and wherein one of the first and second surfaces defines at least one lateral groove and the other one of the first and second surfaces defines at least one lateral rib, the at least one lateral groove receiving therein the at least one lateral rib.

8. A cleaning implement as defined in claim 1, wherein the cleaning element is a sheet of fabric material, a sponge or a cleaning pad.

9. A cleaning implement as defined in claim 1, wherein the elongated pole of the handle is at least three and a half feet in length.

10. A cleaning implement comprising:

a cleaning head, a cleaning element on the cleaning head, that is made of a different material than the cleaning head, and a handle, the handle comprising:

an elongated pole having a top end and a bottom end, the bottom end attached to the cleaning head, an angled hang cap including a substantially straight connecting portion defining a central longitudinal axis, and operatively attached to the top end of the pole and a substantially straight axially elongated gripping portion extending directly from the connecting portion, at an angle relative to the central longitudinal axis, to an end of the cleaning implement and first means mounted to the top end of the pole for connecting the connecting portion of the hang cap to the pole, the gripping portion having a hole for use in removably mounting the cleaning implement onto a hook attached on a wall or other surface.

11. A cleaning implement as defined in claim 10, wherein the hang cap is rotatable relative to the first means.

12. A cleaning implement as defined in claim 11, further comprising second means for preventing the hang cap from moving axially along the central longitudinal axis while enabling rotational movement of the hang cap relative to the pole.

13. A cleaning implement as defined in claim 12, wherein the first means is an end cap defining a first surface, the hang cap defines a second surface, and the second means comprises at least one lateral groove on one of the first and second surfaces and at least one lateral rib on the other one of the first and second surfaces, the at least one lateral groove receiving therein the at least one lateral rib.

14. A cleaning implement as defined in claim 10, further comprising means for cleaning a surface.

15. A cleaning implement as defined in claim 14, wherein the means for cleaning a surface is a sheet of fabric material, sponge or cleaning pad.

16. A cleaning implement as defined in claim 10, wherein the elongated pole of the handle is at least three and a half feet in length.

* * * * *